United States Patent [19]

Wenz et al.

[11] Patent Number: 4,587,915

[45] Date of Patent: May 13, 1986

[54] METHOD AND SEWING MACHINE FOR APPROACHING A PREDETERMINED END POINT OF A SEAM

[75] Inventors: Herbert Wenz; Franz Schneider, both of Kaiserslautern, Fed. Rep. of Germany

[73] Assignee: Pfaff Industriemaschinen GmbH, Fed. Rep. of Germany

[21] Appl. No.: 673,475

[22] Filed: Nov. 20, 1984

[30] Foreign Application Priority Data

Nov. 24, 1983 [DE] Fed. Rep. of Germany ..... 3342391

[51] Int. Cl.[4] ..... D05B 69/22; D05B 69/18; D05B 27/22

[52] U.S. Cl. ..... 112/275; 112/262.1; 112/121.11; 112/316

[58] Field of Search ..... 112/275, 121.11, 121.12, 112/272, 277, 2, 262.1, 314, 315, 316, 317

[56] References Cited

U.S. PATENT DOCUMENTS

| | | | |
|---|---|---|---|
| 4,404,919 | 9/1983 | Martell et al. | 112/262.1 X |
| 4,491,080 | 1/1985 | Hager | 112/262.1 X |
| 4,495,877 | 1/1985 | Willenbacher | 112/275 X |
| 4,526,114 | 7/1985 | Martell et al. | 112/262.1 |
| 4,528,923 | 7/1985 | Hager | 112/275 |

*Primary Examiner*—Peter Nerbun
*Attorney, Agent, or Firm*—McGlew and Tuttle

[57] ABSTRACT

A method for approaching a predeterminable end point of a seam spaced from the edge of a workpiece, with a sewing machine which comprises an adjustable needle and lower transport, a sensor arranged before the needle and triggering the process for the positioning of the needle in the end point during passage through the edge, a pulse generator coupled with the main shaft of the sewing machine for the delivery of counting pulses for a pulse counter, and a micro-computer which controls the action of the feed means as a function of the pulses originating from the sensor and from the pulse generator. To execute a desired shortening of the length of one or more of the last stitches before the end point of a seam, the workpiece is moved back by the difference between the desired stitch length and the stitch length set by the setting device, before execution of the adjusted feed. For correction of the stitch length executed during the feed phase, the cloth feeder is connected with a switching gear controlled by the microcomputer for controlled switching on during its reversed feed phase which precedes the respective forward feed phase.

6 Claims, 4 Drawing Figures

METHOD AND SEWING MACHINE FOR APPROACHING A PREDETERMINED END POINT OF A SEAM

FIELD AND BACKGROUND OF THE INVENTION

This invention relates in general to sewing machines and in particular to a new and useful sewing machine and method for approaching a predetermined end point of a sewn seam which is spaced from an edge of the workpiece.

In an older arrangement disclosed in German patent No. 31 50 141 the shortening of the length of the last stitch before the end is achieved in that the forward movement of the feeder is interrupted by the abrupt lowering thereof when the needle has reached the desired end point of the seam. This measure however, cannot be applied to a sewing machine with needle transport in a simple manner because during forward movement the needle is in the workpiece and its movement would have to be interrupted also. But this involves additional difficulties and considerable expense.

There is an older proposal disclosed in German patent application P No. 33 24 715.3 for the execution of one or more stitches with a shortened stitch length before an end point with the aid of a sewing machine with needle transport. Here the setting gearing for adjustment of the feed length of the cloth feeder and of the needle is readjusted just before execution of the last stitch or stitches in such a way that the cloth feeder and needle also execute only the residual stitch length required in each instance for approaching the end point of the seam.

The invention provides a sewing machine which achieves the approach of the end point without shortening the movement of the feed elements in a forward direction. Thereby an additional novel method for approaching the exact end position in sewing machines with needle transport is now indicated.

In accordance with the method of the invention, the end point of a seam which is spaced from an edge of the workpiece is arrived at with the sewing machine which comprises an adjustable needle and a lower transport body sensing the action of the needle and triggering the process for positioning the needle in the end point during the passage through the edge. In accordance with the invention a pulse generator is coupled with the main shaft of the sewing machine so as to deliver counting pulses for a pulse counter and these are transmitted to a micro-computer which controls the action of the feed as a function of the pulses originating from the sensor and from the pulse generator. With the invention, a desired shortening of the length of one or more of the last stitches before the end point of the seam is effected by moving the workpiece back by a difference between the desired stitch length and the stitch length set by the setting device which controls the feed before the execution of the adjustment of the feed. For correction of the stitch length which is carried out during the feed phase the cloth feeder is connected with a switching gear which is controlled by the micro-computer and effects a controlled switching on of the feed in a reverse feeding phase which precedes the respective forward feeding phase. To obtain a stitch length shortened relative to the set stitch length, the lower feed means for feeding the material is connected with a switching gear which operates the feed under the control of the micro-computer during its reverse feeding phase preceding the respective forward phase. A switching gear advantageously comprises an articulated link transmission which is connected at one end with a crank and with a lift drive for the feeder at the other end by means of a lever arm which is mounted within the housing of the sewing machine. With the device and with a method of the invention, it is possible to utilize the backward movement of the cloth feeding mechanism for the correction of the stitch length executed during the forward movement. By using the articulated link transmission of the invention, a sufficiently rigid connection between the lift drive and the cloth feeder is effected for normal sewing.

One link of the articulated link transmission is held in a stretch position by a spring to effect the outward flexing thereof along with a nose member which projects into the path of a control member. This ensures an exact lifting of the lower cloth feeder in its normally inactive phase with the simultaneous outward pivoting of the articulated link transmission.

Accordingly, it is an object of the invention to provide an improved method for approaching a predeterminable end point of a seam which is being sewn.

A further object of the invention is to provide a sewing machine having means for effecting the precise sewing of a seam along an edge point and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figures 1, 2:
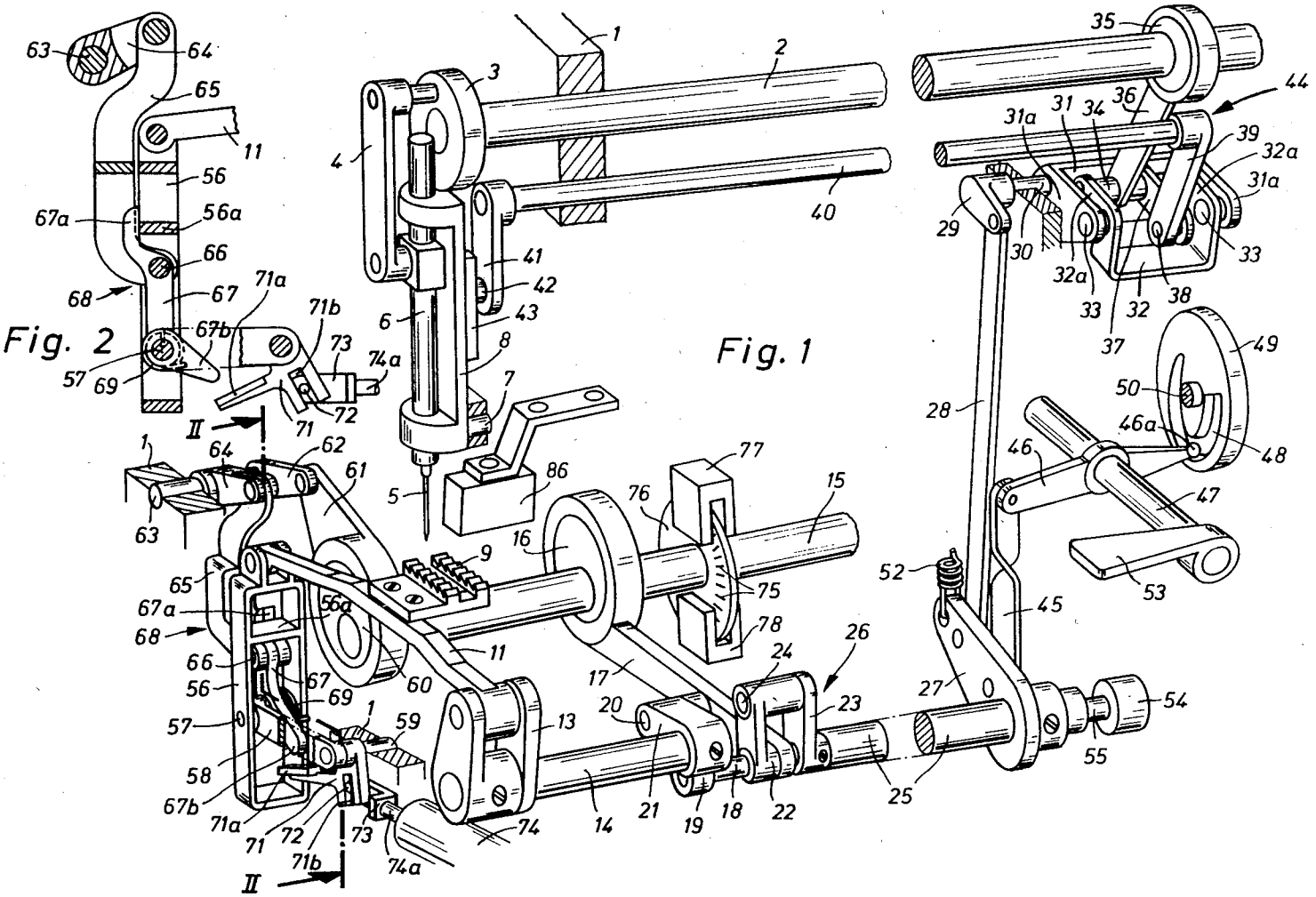
FIG. 1 is a perspective view of the driving mechanism of a sewing machine with lower and needle transport constructed in accordance with the invention.
FIG. 2 is a section taken along the line II—II of FIG. 1, on a larger scale.

Referring to the drawings, in particular the invention embodied therein comprises a sewing machine which includes a main shaft 2 for driving a needle 5 which is mounted for vertical reciprocation and for back and forth swinging movement. A material feed 9 in the form of a feeding dog is positioned adjacent the needle and is movable to move the workpiece or material W relative to the needle. A sensor 86 is arranged before the needle 5 and triggers the drive for positioning the needle in the end point. The apparatus includes a pulse counter which is connected to a pulse generator 77 and 78 and operated by the main shaft for generating pulses which are delivered to the micro-computer 81. Variable drive means are connected to the feed 9 and the main shaft 2 so as to move the feed in a selected direction and at a selected feed movement. The feed mechanism is also controlled by a setting device 49 for effecting the desired feed motion.

As FIG. 1 shows, a main shaft 2, mounted in a merely indicating housing 1 of the sewing machine, drives via a crank 3 and a link 4 a needle bar 6 equipped with a needle 5. The needle bar is mounted in a rocker 8 swinging in a pivot 7.

Figure 4:
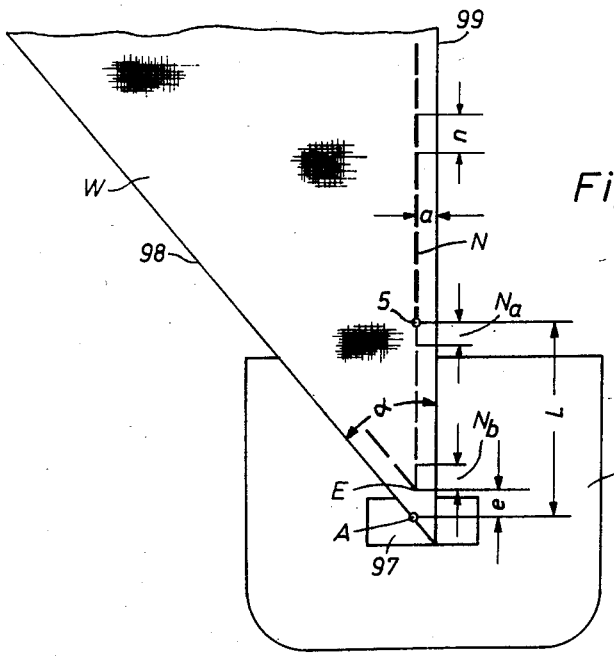
FIG. 4 is a schematic representation of a corner sewing process.

Cooperating with the needle 5 is a shuttle (not shown) as well as a workpiece or a cloth feeder 9, which is fastened on a support 11 mounted below the stitch plate 10 of the sewing machine illustrated in FIG. 4.

The support 11 is connected with a forked crank 13, which is fastened on a rocking shaft 14 mounted in the housing 1. To drive the rocking shaft 14, an eccentric 16 whose eccentric rod 17 is articulated to a journal 18 is fastened on a shaft 15 in drive connection with the main shaft 2 in a ratio 1:1. On the journal 18 is mounted a link 19 which by means of a journal 20 is connected with a crank 21 fastened on the rocking shaft 14. Laterally of the eccentric rod 17, there is fastened on journal 18 a link 22 which embraces a journal 24 carried by a crank 23. The effective length of link 19 equals the effective length of link 22, so that, when the two journals 20 and 24 are aligned with one another, the rocking shaft 14 remains at rest despite the moving eccentric rod 17. To vary the movement of the eccentric rod 17 acting on rocking shaft 14, crank 23 is clamped fast on a positioning shaft 25. The parts 14 and 16 to 25 form a positioning gearing 26 for the feed amount and direction of the cloth feeder 9. The positioning shaft 25 carries a crank 27, which is connected via a link 28 with a crank 29 which is fastened on a positioning shaft 30 mounted in the housing 1. The positioning shaft 30 carries a yoke 31, between whose arms 31*a* an additional yoke 32 is rotatably mounted by means of bolts 33. The arms 32*a* of yoke 32 are connected by a bolt 34, to which swinging movements about the bolts 33 are imparted by an eccentric 35 fastened on the main shaft 2 via an eccentric rod 36. Arranged on bolt 34 is a further link 37, which by means of a bolt 38 is articulated to a crank 39 which is fastened to one end of a rocking shaft 40 extending parallel to the main shaft 2. With the other rocking shaft 40 a crank 41 is connected which carries a journal 42 which is guided between two flanges 43 arranged on the back of rocker 8. The parts 30 to 40 form positioning gear 44 for the feed amount and direction of the needle 5.

Crank 27 is connected via a tie-rod 45 with one end of a rocking lever 46 which is fastened on a shaft 47 mounted in housing 1. The as yet free end of rocking lever 46 has a spherical projection 46a which protrudes between side walls of a setting groove 48 of a setting device 49 the size of the feed movement of feeder 9 and of the needle 5 is determined, the setting groove 48 being formed as a spiral in such a way that stitch lengths of, for example, 1 to 6 mm can be adjusted on the feeder 9 and the needle 5.

Acting on crank 27 is an extension spring 52 which is hooked by its other end to the housing 1 and which brings it about that the projection 46*a* of rocker lever 46, projecting into the setting groove 48, is in permanent contact on the outer of the side walls of setting groove 48 and that feeder 9 in conjunction with needle 5 pushes the work forward. For reversal of the feed direction there is fastened on the end of shaft 47 projecting out of housing 1 a switching lever 53 by which rocking lever 46 can be caused to make contact on the inner side wall of setting groove 48.

In axial prolongation of setting shaft 25 there is arranged on housing 1 a potentiometer 54 whose setting member 55 is fastened in an axial bore of setting shaft 25.

The support 11 is connected with a frame 56 which is mounted on a journal 57. The latter is carried by a lever arm 58, which is mounted on a bolt 59 fastened in housing 1.

On shaft 15 is fastened an eccentric 60 whose eccentric rod 61 is connected with a crank 62 which is fastened on a shaft 63 mounted in housing 1. On shaft 63 a second crank 64 is fastened. The latter is connected with one end of link 65 (see also FIG. 2), whose other forked end is connected with a bolt 66. On the latter a second link 67 is mounted, which is carried by the journal 57 and which forms together with link 65 an articulated link gearing 68.

Mounted on journal 57 is a spiral spring 69, which takes support by one end on frame 56 and whose other end acts on link 67. The latter has a stop 67*a*, which the spiral spring 69 pushes against a cross-web 56*a* of frame 56. Link 67 is provided with a nose 67*b* which protrudes into the path of an abutment surface 71*a* of a control member 71 mounted on bolt 59. Control member 71 has a slot 71*b*, which serves as guide for a pin 72. The latter is fastened on a holding bracket 73, which is connected with a piston rod 74*a* of a compressed air cylinder 74.

Shaft 15 carries a pulse disc 76 provided with a plurality of line marks 75 and cooperating with a pulse generator 78 arranged at 180° thereto. Pulse generator 77 (FIG. 3) is connected via a line 79, and pulse generator 78 via a line 80, with a micro-computer 81.

The line marks 75 (FIG. 1) are present on only a part of the pulse disc 76, namely on the part which during the transport phase of feeder 9 and of needle 5 runs through the pulse generator 77. Thus the generator 77 delivers pulses to the micro-computer 81 via line 79 (FIG. 3) only during the transport phase of the sewing machine, while pulse generator 78 delivers pulses to micro-computer 81 only during the nontransport phase.

One input of micro-computer 81 is connected via a line 82 with the potentiometer 54, another via a line 83 with a schematically shown input device 84, and lastly another input via a line 85 with a sensor 86 which is fastened on housing 1 in front of needle 5 above the stitch forming point.

One output of micro-computer 81 is connected via an amplifier not shown and a line 87 with the switching magnet of a 4/2 way valve 88. The multi-way valve 88 serves for the controlled admission of the compressed air cylinder 74, the compressed air source being marked 89. Another output of micro-computer 81 is connected via a line 90 with a known control circuit, (not shown) of a position motor 91, which is in drive connection with shaft 15 via a belt drive 92.

Lastly a counter 93 is connected via a line 94 to one input and via a line 95 to one output of micro-computer 81. Via a line 96 connected to another output of micro-computer 81 the counter 93 is resettable to "0".

The micro-computer 81 processes the pulses coming in from pulse generator 77 and from sensor 86 according to its preset program in a manner known in itself. In addition, it receives the values dependent on the rotational position of potentiometer 54, which simulate the respective adjusted stitch length. Naturally, instead of using the potentiometer 54 for stitch readjustments, the stitch length to be executed can be entered in the microcomputer 81 by hand via the input device 84.

The sensor 86, consisting of a light emitter and light receiver, is fastened to the housing 1 of the sewing machine at the distance L (FIG. 4) before the path of needle 5. Sensor 86 cooperates with a reflection foil 97 glued to the stitch-plate 10 of the sewing machine. A beam of light coming from the light emitter of sensor 86 falls on a scanning point A and is reflected by reflection foil 97 onto the receiver of sensor 86 if there is no workpiece W. As soon as in the cloth transport an edge 98 of the workpiece W, e.g. of a collar, moves over the scanning point A, the workpiece W interrupts the reflection of the beam and sensor 86 sends a switching pulse to micro-computer 81 via line 85 (see also FIG. 3).

During the production of a seam consisting of stitches N at a spacing a from the edge 99 of workpiece W, sensor 86 signals for example that edge 98 of the workpiece has cleared the scanning point A on the stitch-plate 10 of the sewing machine or respectively on the reflection foil 97 glued thereon, by sending a switching pulse to the micro-computer 81 via line 85. Via line 90 the micro-computer switches the position motor 91 to a predetermined low speed, at which the sewing machine can later be stopped when a predetermined end point E is reached.

At the same time, the counter 93, set to "0", is connected by micro-computer 81 via line 95 to line 79 of pulse generator 77. With continued sewing, the pulses delivered by pulse generator 77 then cause upward counting of counter 93 from "0" on.

The switching on of counter 93 occurs in the transport phase of the sewing machine, because the edge 98 of workpiece W passes through the scanning point A only in this phase. In FIG. 4, the position of needle 5 as counter 93 is being switched on is entered. Now counter 93 counts the pulses delivered by pulse generator 77 from delivery of the switching pulses of sensor 86 to completion of the stitch just begun during the residual stitch length Na, and it gives this number of pulses i at the end of this residual stitch to the micro-computer 81. The computer calculates immediately thereafter, from the distance L and the set stitch length n, the number of complete stitches N still to be executed after the residual stitch length $N_a$ up to the end point E, and in addition the pulse number for the differences between the stitch length n and the calculated residual length $N_b$ for the last shortened stitch.

This computation is dependent on the distance L between needle 5 (FIG. 4) and the scanning point A of sensor 86, on the distance e in the straight prolongation of the seam to be sewn between the end point E and the edge 98 of workpiece W, on the adjusted stitch length n, and lastly on the preset pulse number i during execution of the residual stitch length $N_a$ of stitch N just then executed as sensor 86 responds. The distance L is constant. The residual seam length 1 is the distance from the needle 5 to the predetermined end point E.

The pulse number i depends on the pulse generator 77 used. The distance e is dependent on the edge distance a of the seam from the edge 98 or 99 and on the edge angle alpha of the corner of workpiece W.

Figure 3:
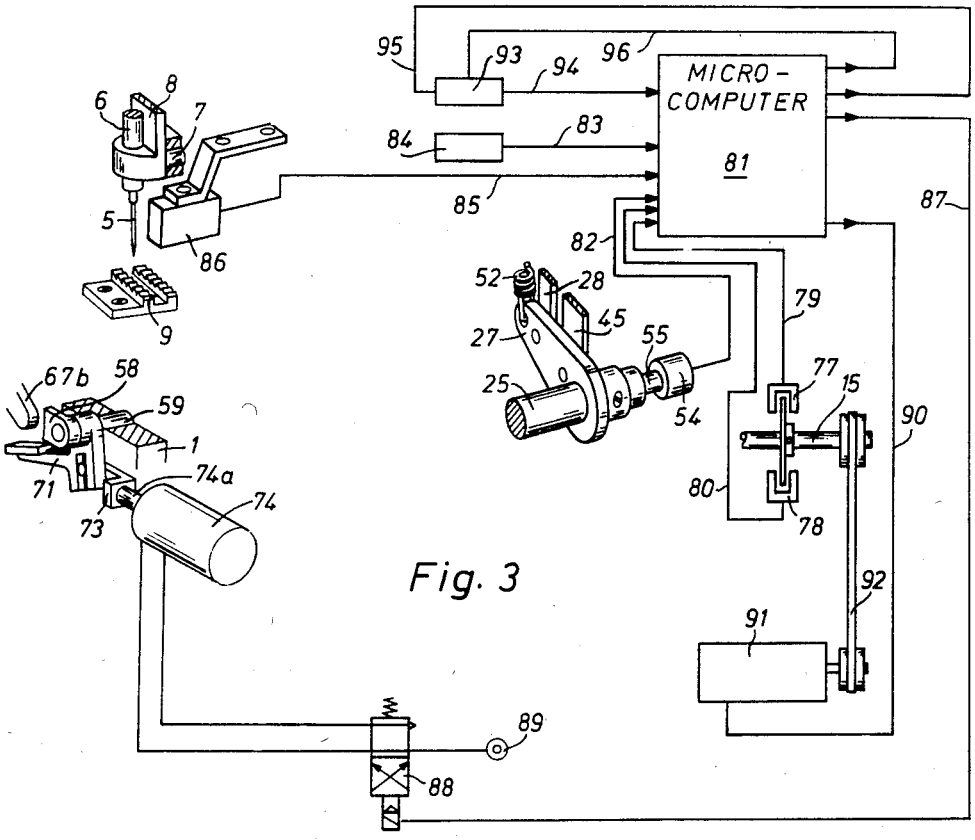
FIG. 3 is the schematic perspective representation of various organs of the control required for approaching a predetermined end point of a seam, with its reciprocal connection.

As the desired stitch length n is being adjusted by the setting device 49 (FIG. 1), the setting shaft 25 is rotated by way of the rocking lever 46, the tie-rod 45, and the crank 27. The resistance of the potentiometer 54 connected with the setting shaft 25 then changes accordingly. This value is entered in the micro-computer 81 via line 82 (FIG. 3).

After execution of the number of complete stitches N as calculated by micro-computer 81, the computer causes the compressed air cylinder 74 to be actuated via the multi-way valve 88 before execution of the residual stitch length $N_b$ within the time in which the advance of the workpiece W by the cloth feeder 9 and the needle 5 is just terminated.

The piston 74*a* of cylinder 74 (FIGS. 1 and 2) pivots the nose 67*b* of link 67, lifts it, then places itself against the underside of lever arm 58 and pivots the latter by an amount which is determined by the stroke end of the adjustably fastened compressed air cylinder 74. During this process, the articulated link gearing 68 is pivoted out by the pivoting of the nose 67*b*, thereby abolishing the rigid connection between frame 56 and crank 64. Upon further pivoting of lever arm 58 by the abutment surface 71*a*, frame 56 is raised and thereby the support 11 with the cloth feeder 9 is pivoted upward. This causes the teeth of the cloth feeder 9 to pass through the stitch-plate 10. At the same time the micro-computer 81 (FIG. 3) sets the counter 93 to the number "0" via line 96, disconnects line 79, and connects line 80.

Now pulse generator 78 sends pulses over line 80 via the microcomputer 81 to the counter 93 until the counter status has reached a pulse number i' which corresponds to the difference between the stitch length n and the calculated residual stitch length $N_b$ for the last shortened stitch.

In the above described process, the workpiece W is moved back by feeder 9 by the difference amount between a stitch length n and the residual stitch length $N_b$ during backward movement of needle 5 and feeder 9. At counter status i', counter 93 delivers a pulse to micro-computer 81 via line 94, owing to which the microcomputer abruptly disconnects the compressed air cylinder 74 over line 87 via the multi-way valve 88, owing to which the control element 71 is pivoted back into its lower end position.

Under the action of spiral spring 69, the two links 65 and 67 are brought into their stretched position until stop 67*a* abuts on frame 56, owing to which the latter moves down and lowers the feeder 9 below the stitch-plate 10. After the lowering of feeder 9, the needle 5 and feeder 9 then move back to their starting position by the amount of the residual stitch length $N_b$ without entrainment of the workpiece W, whereupon needle 5 plunges into workpiece W exactly by the amount of the residual stitch length $N_b$ from the last complete sewing stitch N, the last stitch thus corresponding only to the residual stitch length $N_b$.

Simultaneously with the disconnection of the compressed air cylinder 74 (FIG. 3), the micro-computer 81 gives via line 90 a turn-off command for the position motor 91, which then, after execution of the residual stitch length $N_b$, brings about the stopping of the sewing machine in the low position of needle 5, in a manner known in itself. In this way the seam ends exactly in the predetermined end point E, whereupon the possibility of subsequent rotation of the workpiece W exists.

Even if the disconnect command for the position motor 91 brings about a stopping of the sewing machine with the needle 5 in high position, the conditions for the execution of the residual stitch length $N_b$ remain unchanged.

Deviating from the solution described, the predetermined end point E of the seam can be approached also in a different manner. For example, the micro-computer 81 can, after response of sensor 86 in the scanning point A, calculate the pulse number i' which corresponds to the reverse feed of workpiece W by feeder 9 required to reach the end point E, with a period sufficient therefor, in which stitches N of the previous length are being executed. Then, during execution of the remaining stitches, by brief connection of cylinder 74 by micro-computer 81, uniformly shortened stitches can be executed during the reversed feed phase of feeder 9 to the end point E, the number of pulses calculated for the back-transport of workpiece W being distributed over these remaining stitches.

While a specific embodiment of the invention has been shown and described in detail to illustrate the application of the principles of the invention, it will be understood that the invention may be embodied otherwise without departing from such principles.

What is claimed is:

1. A sewing machine for approaching a selected end point of a seam comprising a main shaft, a needle mounted for vertical reciprocation and for back and forth swinging movement connected to said main shaft for being driven thereby, a material feed positioned adjacent the needle and being movable to move the material relative to the needle, a sensor arranged adjacent said needle and triggering the drive for positioning the needle in the end point, a pulse generator connected to said main shaft for generating pulses and a counter connected to said pulse generator for receiving the pulses generated thereby, variable drive means connected to said material feed and to said main shaft to move said material feed in a selected direction and at a selected feeding movement rate, a setting device connected to said variable drive means for setting the direction in an amount of feed movement and a micro-computer connected to said setting device and said pulse generator and said sensor and said material feed, said micro-computer being set to effect shortening of the length of at least one of the last stitches before the end point of the seam by moving the workpiece backwardly by the difference between the desired stitch length and the stitch length set by said setting device before execution of said forward movement.

2. A sewing machine according to claim 1, wherein said material feed includes a feeding dog which is movable to engage the material in advance or move it backwardly relative to the needle, and articulated link transmission, a crank connected to said articulated link transmission and a lift drive for said feeder actuated by said crank.

3. A sewing machine according to claim 2, wherein said articulated link transmission includes a link held in a stretch position, a spring engaged with said link holding it in a stretch position for the outward flexing of said link, said link having a nose and a control member movable through a path which intersects said nose.

4. A sewing machine according to claim 3, wherein said control member is pivotally mounted on said lever arm and engages said lever arm from below.

5. A method for approaching a predeterminable end point of a seam which is sewn at a spaced location from the edge of a workpiece and using a sewing machine which comprises an adjustable needle and bottom transport which cooperate together and which includes a sensor disposed in front of the needle and which triggers a process positioning the needle in the end point as the edge runs through, and also includes a setting device for setting a stitch length of the seam and a pulse generator coupled with a main shaft of the sewing machine for delivery of counting pulses and delivering them to a pulse counter and including a micro-computer which is connected to control the action of feed means for forward movement of the workpiece in a feed direction as a function of the pulses generated and as a result of those originating from the sensor, comprising shortening the length of at least the last stitch before the end point of the seam by moving the workpiece backwardly with respect to its forward movement by the difference between the desired stitch and the stitch length set by the setting device before execution of the forward movement by the feed means.

6. A method according to claim 5, wherein for the correction of the stitch length executed during a feed phase for approaching the endpoint, the feed means is connected with a switching gear controlled by the micro-computer for controlling the switching on during its backward moving which precedes the respective forward movement.

* * * * *